United States Patent [19]

Yoshimura et al.

[11] 4,055,732

[45] Oct. 25, 1977

[54] INBOARD TYPE MAGNETIC SYSTEM FOR ELECTRO-DYNAMIC TRANSDUCER

[75] Inventors: Hisashi Yoshimura, Minoo; Sadao Yukimoto, Neyagawa; Takashi Matsumoto, Hirakata; Isago Konno, Neyagawa; Nobuyuki Kato; Tadao Ohtani, both of Katano; Takao Kubo, Kawachinagano, all of Japan

[73] Assignee: Matsushita Electric Industrial Company Limited, Osaka, Japan

[21] Appl. No.: 636,960

[22] Filed: Dec. 2, 1975

[30] Foreign Application Priority Data

Dec. 2, 1974 Japan ..... 49-139322

[51] Int. Cl.[2] ..... H04R 9/02; B21C 23/00; C22C 22/00

[52] U.S. Cl. ..... 179/117; 29/594; 72/253 R; 75/134 M; 148/120

[58] Field of Search ..... 179/115.5 R, 117, 120

[56] References Cited

U.S. PATENT DOCUMENTS

| | | | |
|---|---|---|---|
| 3,116,181 | 12/1963 | Hokkeling et al. | 75/134 M |
| 3,661,567 | 5/1972 | Yamamoto | 75/134 M |
| 3,730,784 | 5/1973 | Yamamoto | 75/134 M |
| 3,976,519 | 8/1976 | Kubo et al. | 148/120 |

FOREIGN PATENT DOCUMENTS

| | | | |
|---|---|---|---|
| 943,787 | 7/1949 | Germany | 179/117 |

*Primary Examiner*—George G. Stellar
*Attorney, Agent, or Firm*—Wenderoth, Lind & Ponack

[57] ABSTRACT

An inboard type magnetic system for an electrodynamic transducer which has a reduced height and magnetic flux leakage by making use of a manganese-aluminum-carbon system alloy magnet anisotropized by warm extrusion.

2 Claims, 4 Drawing Figures

INBOARD TYPE MAGNETIC SYSTEM FOR ELECTRO-DYNAMIC TRANSDUCER

BACKGROUND OF THE INVENTION

The present invention relates to inboard type magnetic system for an electro-dynamic transducer and particularly pertains to a loud-speaker.

The magnets used in the magnetic system of ordinary load-speakers are mostly Alnico magnets and ferrite magnets, the former being used mainly in the inboard type magnetic systems of medium and small size loud-speakers, and the latter mainly in the outboard type magnetic systems of large loud-speakers.

Of late, it is the trend that increasingly larger loud-speakers are being employed for improvement of the tone quality in portable sonic devices including radios, cassette tape recorders, etc., and as the loud-speaker grows larger, the device as a whole is enlarged, especially being given an increased height or thickness, resulting in reduced portability of such portable devices. For this reason, the reduction in height or thickness of loud-speakers is particularly desired. The loud-speaker must be so arranged that the magnetic flux leaking from the loud-speaker will not affect Braun tubes, medium frequency transformers, etc., in color television and portable radio sets, etc. The outboard type loud-speakers in which ferrite magnets are used cannot be adopted for such uses because of the very large magnetic flux leakage, and for this reason, usually, loud-speakers in which the inboard type magnetic systems are used are employed. In the case of the inboard type systems, however, conventional products, because of the substantial magnetic flux leakage, must have the parts arranged with some spacing thereof, and accordingly, the size-reduction for such systems is believed to have already approached the ultimate limit.

Heretofore, it has been commonly known that the increase in the residual flux density B*r* and in the gap flux density B*g* which works effectively on the voice coil is a sine qua non and thus an Alnico 5DG magnet is employed for the magnetic systems of loud-speakers.

FIG. 1 is a section of an inboard type magnetic system in which a conventional Alnico magnet is employed, in which 1 denotes the Alnico 5DG magnet; 2, the mild steel yoke; 3, the mild steel center pole, and 4, the voice coil, with the arrows indicating the magnetic fluxes. $\phi 1$ designates the gap magnetic flux which effectively works on the voice coil; $\phi 2$, the magnetic flux leakage between the top of the center pole 3 and the top of the yoke; $\phi 3$ the magnetic flux leakage between the outer circumference of the magnet 1 and the center pole 3 and the inner circumference of the yoke 2; and $\phi 4$, the magnetic flux leakage from the back of the yoke.

As for ferrite magnets, because the B*r* thereof is so small, magnets with large areas become necessary, making it difficult to adopt them for use in the inboard type structure; as a consequence, the flux leakage is very large; the utilization efficiency of magnetic fluxes is lower than in the inboard type; the area and diameter required for magnetic devices are larger, and moreover, the yoke is required to be very thick.

In addition to the foregoing, for answering the recent demand for the preservation of resources and energy, that is, the demand for reduction in the current and power consumption, many attempts have been made to improve the efficiency of loud-speakers. Some methods for reducing the gap and increasing B*g* by way of improving the voice coil winding method have been contemplated, but these methods have attained an improvement in efficiency of at most about 5%, and the alternative structures of the magnetic devices have already been exhaustively developed.

Furthermore, in an attempt to reduce the leakage of magnetic fluxes toward the back of the loud-speaker, there has been contemplated a method in which a hollow layer is formed in the yoke on the back of the magnetic device, to increase the magnetic resistance, thereby reducing the leakage backward of magnetic fluxes, but in this method, the magnetic system will inevitably be made higher or thicker.

The Alnico base magnets have a large permeance coefficient P at their optimum operating points, that of Alnico 5DG being $P = 17 \sim 18$ G/Oe. Accordingly, if the magnetic energy is to be effectively utilized, the ratio of the height to the diameter of the magnet L/D must increase, necessitating the magnetic system to be higher.

Moreover, according to the conventional design approach, B*g* is increased by focusing the magnetic fluxes by use of the center pole. By this, the magnetic system is made higher and higher, and its weight becomes greater.

BRIEF SUMMARY OF THE INVENTION

Accordingly, it is an object of the present invention to provide an inboard type magnetic system for an electro-dynamic transducer in which both the height and weight of the magnetic system are cut down and the magnetic flux leakage is markedly reduced.

The object is achieved by an inboard type magnetic system for an electro-dynamic transducer having a permanent magnet, a yoke which is mounted on the one end of said permanent magnet to construct a magnetic circuit, a center pole which is mounted on the other end of said permanent magnet and a voice coil which is arranged in a space provided between said yoke and said center pole, wherein said permanent magnet is an alloy having a composition of 68.0 to 73.0% by weight of manganese, (1/10 Mn — 6.6)% to ($\frac{1}{3}$ Mn — 22.2)% by weight of carbon and the remainder aluminum and is anisotropized by warm extrusion, whereby the system is made thin.

Other and further objects, features and advantages of the present invention will appear more fully from the following description.

DETAILED DESCRIPTION OF THE PREFERRED EMBODIMENTS

The present invention provides an inboard type magnetic system for an electro-dynamic transducer such as a loud-speaker in which the usual difficulties are resolved by making use of anisotropic Mn-Al-C system magnets which have been given anisotropic characteristics, i.e., by warm plastic deformation; thus, as compared with the devices in which Alnico 5DG magnets are employed, both the height and weight of the magnetic system are cut down by about one-third, and the magnetic flux leakage is markedly reduced.

The characteristics of and a manufacturing method for the anisotropic Mn-Al-C system magnets of the present invention are described hereunder: Mn-Al-C alloys with compositions of Mn 68.0 ~ 73.0 Wt %, C in an amount from a minimum of (one-tenth the amount of Mn — 6.6) Wt % to a maximum of ⅓ the amount of Mn — 22.2 ) Wt %, balance Al, are melted and cast, then subjected to a necessary heat treatment, and thereafter, are anisotropized by warm plastic deformation at a temperature in a range of 530° ~ 830° C. Their magnetic characteristics are: Br = 6000 ~ 6500 G, BHC = 2000 ~ 3000 Oe, $(BH)_{max} = 5 \sim 8 \times 10^6$G·Oe, and their maximum energy product is given at $P = 2 \sim 3$ G/Oe. The present inventors, as a result of detailed studies of the characteristic features of the Mn-Al-C system magnets anisotropized by warm plastic deformation, have successfully discovered a hitherto unknown new effect in magnetic systems for use in electro-dynamic transducers such as a speaker which is not merely based on their higher BHC and $(BH)_{max}$ and low specific gravity, which is 5.1, but which is inherently derived from the use of the Mn-Al-C system magnets anisotropized by warm plastic deformation. In the following, this invention is described in detail in reference to a specific embodiment.

Figure 1:
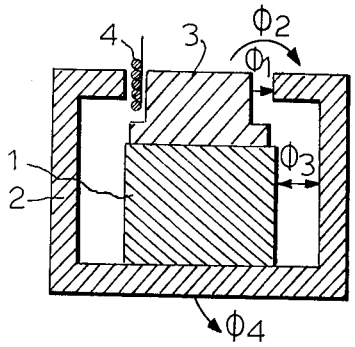
(PRIOR ART) FIG.1
FIG. 1 is a sectional view of the inboard type magnetic system used in conventional loud-speakers.
Figure 2:
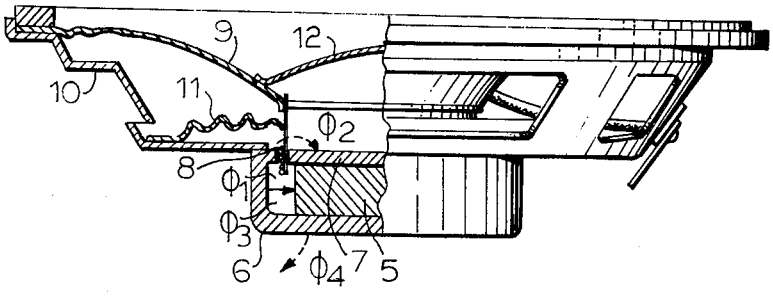
FIG. 2 is a partial sectional front view showing a loud-speaker embodying this invention.

FIG. 2 is a partial sectional front view of a loudspeaker in which the magnetic system of this invention is employed. An Mn-Al-C system magnet 5 has a magnetic yoke 6 made of a mild steel attached to one end and a magnetic center pole 7 made of a mild steel attached at the other end. A voice coil 8 in the gap between yoke 6 and center pole 7 is attached to a vibrating plate 9 on a frame 10. A conventional damper 11 and a dust cap are provided. Magnetic fluxes $\phi$1, $\phi$2, $\phi$3 and $\phi$4 are indicated by the arrows corresponding to those of FIG. 1.

While the anisotropic Mn-Al-C system magnets 5 naturally have reduced $L/D$ in their optimum shapes because of their small permeance coefficient $P$ at their optimum operating point, the reduction in height or thickness of the magnetic system of the loud-speakers of this invention is achieved not merely on the basis of the small permeance coefficient, but also due to the inherent characteristic feature of the Mn-Al-C system magnets anisotropized by warm plastic deformation.

First, the result of a detailed examination of the relationship between $P$ and $L/D$ in the magnet unit has revealed that when $P = 3$ G/Oe in the axial direction of cylindrical magnets, the Alnico 5DG magnets have an $L/D = 1.0$, while the Mn-Al-C base magnets have an $L/D = 0.8$, indicating that the height of the magnet may be reduced. Furthermore, the Mn-Al-C magnets anisotropized by warm plastic deformation undergo almost no demagnetization at low temperatures, which is not so with other conventional magnets, the demagnetization being less than 1% at −60° C. The low temperature demagnetization of the conventional magnets such as anisotropic Ba ferrite magnets depends on $L/D$; the smaller the $L/D$, the larger the demagnetization. On this ground, too, these magnets may be designed with a small $L/D$.

Figure 3:
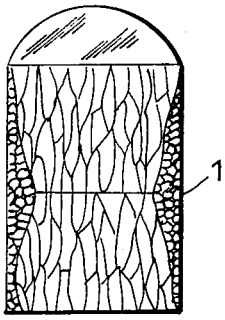
FIG. 3 is an explanatory sketch showing the structure in a section of the conventional Alnico magnet.

Secondly, with regard to the manufacturing method of magnets, in the Alnico 5DG magnet 1, for its anisotropization, the azimuth of the crystal needs to be oriented at the time of casting first of all, for which purpose columnar-crystallization is obtained by use of chilling; in the macroscopic structure viewed in section, however, as shown by the sketch in FIG. 3, columnar crystallization cannot be achieved, and a granular chilled layer is left in the outer circumferential part; columnar crystallization of about 70% is usually regarded as the limit in the industrial manufacture of magnets. Accordingly, it is inherently impossible to have the predominating magnetization axis completely oriented in the outer circumferential part of the magnet; some diametral direction components are left; consequently, the magnetic flux leaakage $\phi$3 in the speaker of FIG. 2 increases, and because of the high magnetic flux density at the center of the end face of the magnet, the center pole and the yoke need to be made thick; and for this reason, if the center plate and the yoke are made thin as in the present invention, the magnetic flux leakages $\phi$2, $\phi$3 and $\phi$4 are markedly increased.

Figure 4:
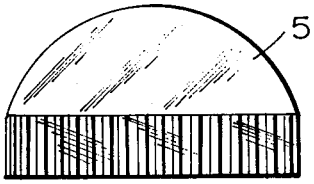
FIG. 4 is an explanatory sketch showing the structure in a section of the manganese-aluminum-carbon system alloy magnets of this invention.

In the Mn-Al-C system magnets, 5, the direction of crystal growth need not to be controlled at the time of casting. Thus, by the plastic deformation, the predominating magnetization axis direction is oriented and moreover, the grain of the crystals is refined. As a result, as shown by the sketch of the structure in section in FIG. 4, the structure is nearly homogeneous, there being no heterogeneous peripheral layer such as in Alnico 5DG, but conversely to the situation in the case of Alnico 5DG magnets, the degree of anisotropization is rather higher in the vicinity of the outer circumferential part than in the interior, thus providing abundant axial direction components in the predominating magnetization direction for better magnetic characteristics including coercive force, etc.

The mechanism by which these alloys are magnetically anisotropized through plastic deformation is different from the mechanism of forming the mere deformed texture in common metal materials; it involves elemental conversion of the predominating magnetization direction through recombination of the crystal lattice. Accordingly, the magnetic characteristics and the degree of anisotropization are noticeably influenced by the method of plastic deformation and the conditions under which it is carried out.

The measurement, taken by using a micro-Hall element, of the magnetic flux distribution on the surface of a unit magnet magnetized in its axial direction has confirmed that whereas the Alnico 5DG has substantial leakage in the lateral direction, that is, the diametral direction, Mn-Al-C system magnets allow almost no such leakage.

It has been made clear that especially when a warm extruding process is utilized for the manufacturing method of Mn-Al-C base magnets for the magnetic system of speakers, the magnetic characteristics of the magnets may be altered by the choice of the conditions of extrusion, e.g., by changing the extrusion ratio, die angle, resistance to deformation of the material, temperature, the condition of lubrication, etc. The result of studies of these essential factors shows that a warm extruding process for the anisotropic Mn-Al-C system magnets is well-suited for controlling the condition of deformation in the interior of the material, and thus, consequently the characteristic distribution in the interior of the magnet; accordingly, this process not only makes the magnetic characteristics of the interior of the material uniform both inside and out, but it also makes it possible to further improve the magnetic properties or the degree of anisotropization in the outer circumferential part, as previously described.

For example, when a specimen is subjected to warm extrusion at a temperature of 620° to 750° C through a conical die which has an extrusion ratio of 2.5 to 12 and a semiangle, i.e. half the cone angle, of 5° to 15°, wherein the frictional coefficient between the specimen and the inner surface of the die is no greater than 0.2, it is observed a tendency for the coercive force and degree of anisotropization especially to become greater at the peripheral portion of the specimen. An example of such an experiment is as follows.

Mn-Al-C alloy which has a composition within the above-described range was melted, cast, and after being held at a temperature for 2 hours, for solutionizing the alloy, i.e., for making the alloy a single phase material, quenched at 600° C for 30 minutes. Then, it was subjected to warm extrusion at 700° C through a conical die which had an extrusion ratio of 5 and semiangle of 10°, lubricating being by graphite lubricant. By these steps an anisotropic Mn-Al-C magnet having a diameter of 30 mm was obtained. Specimens of 3mm cube were cut out from both the central portion and peripheral portion (the portion being selected in such a manner that one side of the cube was a chord of the periphery of the magnet) of that magnet. Magnetic properties of those specimens were as follows.

They had a direction of preferred magnetization in the extruding direction and magnetic properties in this direction were, in respect to the specimen from the peripheral portion, B*r* is 6600G, BHC: 2600 Oe; (BH)max: 7.8 MG Oe; and peak value of magnetic torque $0.9 \times 10^7$ dyne cm/cm$^3$, whereas with respect to the specimen from the central portion B*r* was 6100G, BHC was 2400 Oe, (BH)max was 6.0 Oe, and peak value of magnetic torque is $0.7 \times 10^7$ dyne cm/cm$^3$.

With respect to the specimens subjected to treatments under conditions which did not fall in the above-mentioned range, said tendency was scarcely observed.

When magnetic systems were set up using magnets with such irregular magnetic characteristics, the efficiency was further improved over that obtained using magnets with uniform characteristics.

Furthermore, according to this invention, the former design concept of increasing the magnetic flux density B*g* in the gap which affects the voice coil is discarded, and without increasing B*g* by reducing the center pole diameter, the magnetic flux leakages $\phi 2$, $\phi 3$ and $\phi 4$ are decreased by making the diameter of the center plate 7 approximately equal to the diameter of the magnet; that is, the total magnetic flux working on the voice coil is increased for its efficient utilization. According to this invention, even when the thicknesses of the center plate 2 and the yoke 6 are reduced by about two-thirds, as compared with the conventional systems in which the Alnico magnets are used, the utilization efficiency of magnetic flux, i.e., the utilization efficiency of magnetic energy, is improved by more than 15%, and at the same time, the magnetic system is made about ⅓ the thickness of the conventional system such as in FIG. 1.

Moreover, it has been found that the Mn-Al-C system magnets anisotropized by warm plastic deformation have high mechanical strengths, having tensile strengths, bending and pressure resistances reaching several times those of the Alnico and the ferrite magnets, as well as very excellent thermal shock resistance, and also have such excellent machinability that they are amenable to stepped cutting, drilling, tapping, etc., on lathes. Accordingly, in the assembling process of the magnetic system, the usual steps, in which after the centering between the yoke, center pole and magnet is adjusted by making use of spacers, the magnet is securely fixed in position by bonding it with resin, are replaced by fixing the magnet and center pole to the yoke by forcing the magnetic in under pressure, screwing it in, caulking it in position, shrink fitting it with yoke, etc., thereby achieving a great simplification of the process.

When the magnetic systems of actual speakers with a 16 cm bore and capable of producing a sound pressure of 100 dB are compared, in the conventional system in which the Alnico 5DG is used, the dimensions of the magnet are 25 mm in diameter × 20 mm long, and the weight is 71.6 g; in contrast, the magnet in the system of this invention is greatly reduced both in weight and volume, with the dimensions of the magnet being 30 mm × 8 mm long, and having a weight of 28.8 g, and furthermore, the weight ratio of the magnetic system as a whole is reduced to about one-third of the conventional system. That is to say, the acoustic output per unit weight of the magnetic system of the present system is more than 3 times larger than that of the conventional system, and the maximum input may be increased by more than 6 times. Furthermore, *L/D* of the Alnico 5DG is more than 0.8, whereas that of the magnet of this invention can be selected to be within a range of 0.1 ~ 0.3, and the height of the magnetic system of this invention is 14 mm in contrast to 37 mm for the conventional systems in which the Alnico 5DG magnets are used and 19 mm for those systems in which the ferrite magnets are used; thus, a reduction of height to as little as about one-third of the conventional system in which the Alnico magnets are used has been achieved. To be sure, further reduction in thickness can be attained through omission of the center pole.

Furthermore, by changing the diameter of the voice coil from 19 mm for a conventional one to 32 mm, the cone part of the speakers with an identical bore may be designed with smaller apex angle $\alpha$ of the opening of the cone for a given height, so that the high range reproduction limit frequency $f_h$ will be increased by decreasing the compliance at the root of the cone. Thus, wide band reproduction can be achieved with a single unit speaker. It is no doubt possible to obtain still thinner speakers in which the cone part is made less high while keeping the apex angle of the opening described above equal to that of the conventional system.

The breakdown of a speaker is caused by the heating of the voice coil due to the input current. In contrast to the conventional speakers, in which the voice coil with a 19 mm diameter, having a small surface area, reaches very high temperatures locally, in the speakers of this invention having the same characteristics as those of the former, the voice col of 32 mm diameter has a large thermal capacity, and has a large heat radiating surface area, facilitating the dispersion of heat, thereby making it possible to minimize the temperature rise; accordingly, breakdown due to heat is made less likely, and speakers capable of withstanding more than twice as large an input as in the case of conventional speakers have been made possible. Moreover, since the temperature rise of the winding of the voice coil is small, the lineality of the output sound pressure of the speaker relative to the input be improved.

In the case of the voice coil in conventional speakers, when wound for a speaker with a given impedance, the number of windings is greater than that of the speaker of this invention, and the inductance of the voice coil due to this increase cannot be neglected; the increased fluctuation of the impedance may have a bad effect on the amplifier by means of which the coil is operated. In the case of the voice coil in the speakers of this invention, the coil diameter is large, and the number of windings is small, thus enabling an on-the-spot resolution of the above-described difficulties.

Furthermore, with regard to the leakage to the outside of magnetic fluxes, $\phi 4$ in particular, in contrast to the conventional inboard type magnetic devices having Alnico base magnets, in which in spite of the use of a yoke plate 4.5 mm thick, the surface magnetic flux density is higher than 50 G, in the devices of this invention, it is one-tenth of the value given above, being lower than 5G, even when the thickness of the yoke plate is decreased to 3 mm. The reduction in thickness of the yoke plate has such favorable additional effects as simplification of the manufacturing process of the yoke from the usual forgoing to the plate working, punching and contraction, and so on.

These effects are also achieved in some type speakers, too.

As described in the foregoing, according to the present invention, by using the anisotropic Mn-Al-C system magnets and using the breakthrough from the former concept in an effort to effectively utilize their characteristic features, a reduction in thickness and weight, a great reduction of the magnetic flux leakage to the outside as well as high performance and high efficiency have been simultaneously achieved, and also simplification of the assembling process has been achieved, enabling the manufacturers to produce compact devices with high efficiency and with a saving of labor in the assembling process.

In the foregoing embodiments, the permanent magnet having a circular cross-sectional configuration is used in the magnetic system, but a magnet having any other cross-sectional configuration such as a square, a pentagon and the like is also usable. Furthermore it is no doubt possible to adopt the magnetic system of this invention not only for speakers but for microphones and other transducers as well.

What we claim is:

1. An inboard type magnetic system for an electrodynamic transducer having an anisotropic permanent magnet with magnetic characteristics that the direction of the preferred magnetization is between the ends thereof and the degree of anisotropization in the outer circumferential part thereof is larger than that in the inner part, a yoke which is mounted on one end of said permanent magnet to form a magnetic circuit therewith, a center pole which is mounted on the other end of said permanent magnet and a voice coil which is arranged in a space provided between said yoke and said center pole, wherein said permanent magnet is comprised of an alloy composition of 68.0 to 73.0% by weight of manganese, carbon in an amount of from (one-tenth the amount of Mn—6.6) weight % to (one-third the amount of Mn—22.2) weight %, and the remainder aluminum, and said magnet being of a magnetic material which has been subjected to warm extrusion at a temperature in the range of 620° - 750° C through a conical die which has extrusion ratio of 2.5 to 12 and semiangle of 5° to 15° for giving it anisotropic magnetic characteristics with the direction of the preferred magnetization in the direction of the warm extrusion and for making the degree of anisotropization in the outer circumferential part of said permanent magnet larger than that in the inner part, whereby the magnetic system can be made thin.

2. An inboard type magnetic system according to claim 1, wherein said permanent magnet is cylindrical and the ratio between the height and the diameter, $L/D$, being $0.1 \sim 0.3$.

* * * * *